US005522628A

United States Patent [19]

Fillis

[11] Patent Number: 5,522,628

[45] Date of Patent: Jun. 4, 1996

[54] SANITARY PAPERBOARD SCOOP-ACTION CARTON

[76] Inventor: Steven J. Fillis, 342-47th St. NW., Canton, Ohio 44709

[21] Appl. No.: 337,850

[22] Filed: Nov. 14, 1994

[51] Int. Cl.[6] ..... A01K 29/00; B65D 5/08

[52] U.S. Cl. ..... 294/1.3; 229/117

[58] Field of Search ..... 294/1.3, 1.4, 55; 119/95, 161, 165, 168; 15/257.1, 257.6; 229/100, 103, 117, 122.2, 124, 126, 127

[56] References Cited

U.S. PATENT DOCUMENTS

| | | | |
|---|---|---|---|
| 3,927,824 | 12/1975 | Razziano | 229/117 |
| 3,971,503 | 7/1976 | Allan et al. | 294/1.3 |
| 4,200,319 | 4/1980 | Cooper | 294/1.4 |
| 4,222,598 | 9/1980 | Ullger | 294/1.3 |
| 4,230,261 | 10/1980 | Austin | 229/117 |
| 4,541,360 | 9/1985 | Higgins et al. | 294/1.3 X |
| 4,583,678 | 4/1986 | Weimer | 229/117 X |
| 4,767,051 | 8/1988 | Single | 229/117 X |
| 5,186,384 | 2/1993 | Nelson | 294/1.3 X |

FOREIGN PATENT DOCUMENTS

| | | | |
|---|---|---|---|
| 4013479 | 1/1991 | Germany | 294/1.3 |

*Primary Examiner*—Johnny D. Cherry

[57] ABSTRACT

A container, of knock-down variety, for picking up, enclosing, transporting and disposing of animal waste that is accomplished by a single piece of flat paperboard with folds, adhesive, tab locks and an auto-erected lock top. After it is erected, side flaps extend out from the open side of the carton. The pressure applied to the top of the carton causes the side flap panels on the open side to fold under. This creates a scooping action which picks up the waste and pushes it inside the carton. The side flaps can then be slipped into the tab locks, effectively locking the waste inside the box, and the entire carton can be thrown away.

6 Claims, 1 Drawing Sheet

SANITARY PAPERBOARD SCOOP-ACTION CARTON

BACKGROUND OF THE INVENTION

1. Field of the Invention

The present invention relates to a device for the scooping and disposing of animal waste. More specifically, the present invention relates to a folding carton that may be expanded readily from flat to set-up position for the scooping and disposal of animal waste.

2. Prior Art

One of the drawbacks of owning a pet in the city is disposing of animal waste. Most cities have curb laws which make it illegal not to clean up after your pet. Special plastic scoopers with a spring mechanism are available to help owners remove pet waste from the streets and parks. However, the scoop itself can become messy and needs to be cleaned or rinsed after each use. It must be carried back to the house or apartment after it is used in order to be cleaned. The Pooper Scooper is the perfect alternative to this messy problem.

SUMMARY OF THE INVENTION

The principle object of the present invention is to provide a new way of removing animal waste from sidewalks, streets and parks.

It is also an object of the present invention to provide such a device which is disposable and of a simple, inexpensive construction.

The foregoing objects can be accomplished by a single piece of flat paperboard with folds, adhesive and tab locks which can be easily assembled to create a small box that is open on one side. After it is erected, side flaps extend out from the open side of the box. The Pooper Scooper is easy to use. After folding and assembling the box, hold it with the open side downward and place it over the waste, press down on the Pooper Scooper. The pressure applied to the top of the box causes the side flap panels on the open side of the box to fold under. This creates a scooping action which picks up the waste and pushes it inside the pooper scooper. The side flaps can then be slipped inside the tab locks, effectively locking the waste inside the box, and the entire Pooper Scooper can be thrown away.

DESCRIPTION OF THE PREFERRED EMBODIMENT

Figure 1:
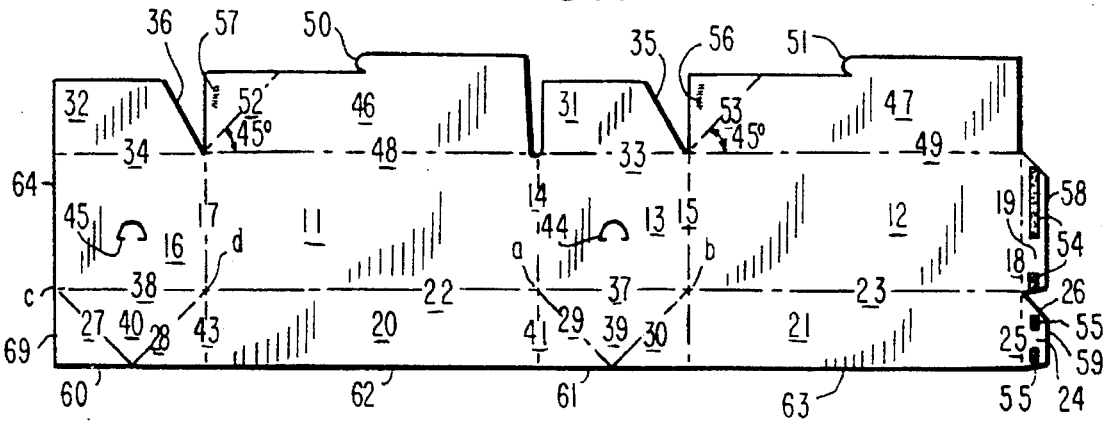
FIG. 1 illustrates the blank of the carton in accordance with the present invention.

Referring first to FIG. 1, the carton there illustrated includes a pair of sidewall panels 11 and 12, each having a shorter edge attached to opposite sides of an endwall panel

13 along score lines 14 and 15, respectively. Along their opposite edges at score lines 17 and 18 respectively are attached endwall panel 16 and glue flap 19, respectively.

Side flap panels 20 and 21 are attached to sidewall panels 11 and 12, respectively along score lines 22 and 23, respectively. Glue flap 24 is connected to side flap 21 along score line 25. Glue flap 24 is further characterized by beveled outer free edge 26. This beveled shape is of a sufficient angle, in relation to the angle of score line 27, so as not to extend over the scored edge when the carton is in a glued and either folded or expanded position. Side flap panels 20 and 21 are further characterized by outer free edges 62 and 63, respectively.

Endwall panel top flaps 31 and 32 are connected to endwall panels 13 and 16, respectively along score lines 33 and 34, respectively. Endwall panel top flaps 31 and 32 are further characterized by beveled outer free edges 35 and 36, respectively. This beveled shape is of a sufficient angle not to exceed the angle of score lines 53 and 52, respectively so as not to extend over the scored edge when the carton is in a glued and either folded or expanded position.

Along the opposite edges of endwall panels 13 and 16 at score lines 37 and 38, respectively are attached side flaps 39 and 40, respectively. Side flap 39 is attached to side flap panels 20 and 21 along score lines 41 and 42, respectively. Side flap 40 is attached to side flap panel 20 along score line 43. Side flap 39 is further characterized by angled score line 29 running from point a to midpoint of outer free edge 61 and score line 30 running from point b to midpoint of outer free edge 61. Side flap 40 is further characterized by angled score line 27 running from point c to midpoint of outer free edge 60 and score line 28 running from point d to midpoint of outer free edge 60.

Endwall panels 13 and 16 are further characterized by cut-out, half-circle tab locks attached along score lines 44 and 45. The distance from score lines 37 and 38 to the top of their respective cut-out, half-circle tab locks should be slightly less than the length of parallel score lines 41 and 42 for score line 37 and less than the length of parallel score line 43 and outer free edge 69 for score line 38.

Top panels 46 and 47 are attached to sidewall panels 11 and 12, respectively along score lines 48 and 49, respectively. Top panels 46 and 47 are further characterized by standard interlocking tab locks 50 and 51, respectively and by score lines 52 and 53, respectively. Score lines 52 and 53 are each situated at a 45° angle from score lines 48 and 49, respectively.

Glue lines 54 and 55 run along the same line and parallel to outer free edges 58 and 59, respectively and are also parallel to glue lines 56 and 57 since parallel application of glue on such a blank is much easier, requiring simpler gluing machinery using the technique and equipment customarily used in the folding carton industry.

Figure 2:
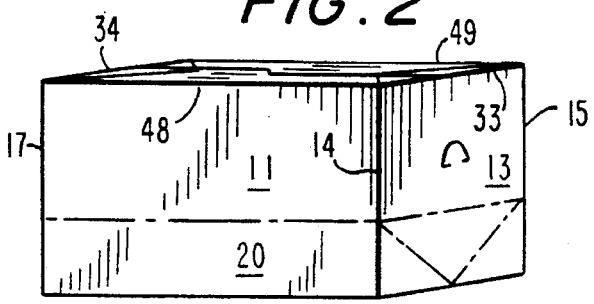
FIG. 2 shows the blank of FIG. 1 assembled in a partially expanded condition.

In order to better illustrate the folded position of a carton of the present invention, FIG. 2 shows the carton in a partially folded position. This carton, which is easily formed by conventional folding machinery, has been formed by first folding the carton blank along score lines 33, 34, 48 and 49 and after applying glue lines 54, 55, 56 and 57 to underside of the carton blank, then folding the blank along score lines 14, 18, 25, 41, 52 and 53, thereby forming the carton in its closed and flattened position. In this position score lines 18 and 25 lie immediately adjacent to outer free edges 64 and 69, respectively.

Figure 3:
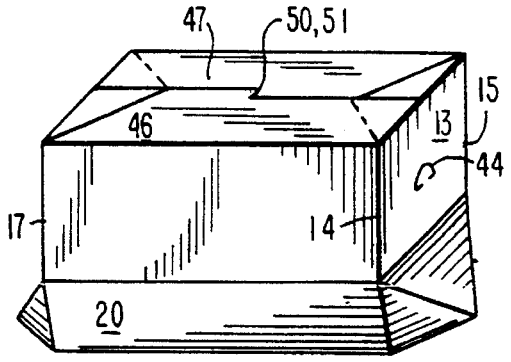
FIG. 3 is a perspective view of the carton of FIG. 2 in set up condition ready for the scooping and insertion of waste therein.

When the carton is to be used, will be shaped to its useful form as shown in FIG. 3. This is easily accomplished by pushing, with the fingers, along score lines 14 and 18. Due to the interlocking of tab locks 50 and 51 along top panels 46 and 47, respectively, the carton will be formed in a positive manner so as not to return to a flattened position.

Figure 4:
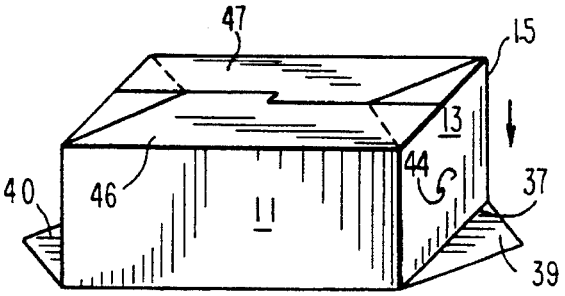
FIG.4 is a perspective view of the carton of FIG. 3 after scooping action has occurred.
Figure 5:
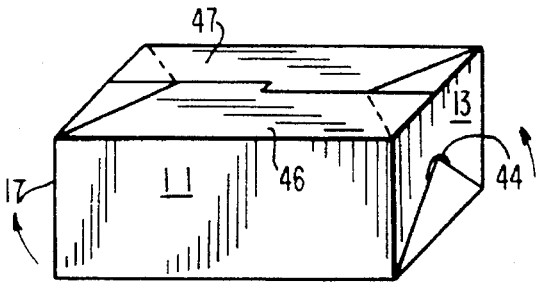
FIG. 5 shows a perspective view of the carton of FIG. 4 after side flaps have been secured into tab locks, locking the scooped contents into the carton.

It will be noted, as clearly illustrated in FIG. 4, that side flaps 39 and 40 extend outward from the carton alter side flap panels 20 and 21, along score lines 22 and 23, respectively, have scooped up the contents. This outward extension, in cooperation with score lines 37 and 38, allows side flaps 39 and 40 to be secured into cut-out tab locks along score lines 44 and 45, respectively, thus securing the contents into the locked carton.

It will be apparent that modifications in accordance with the present invention can be made by those skilled in the art without departing from the spirit thereof, and it is equally apparent that the assembly involving the application of glue and folding of the carton blank may be re-arranged in the order of accomplishing these steps without departing from the scope of the invention.

It will be obvious to those skilled in the art that various changes may be made without departing from the scope of the invention; and the invention is not to be considered limited to what is shown in the drawings and described in the specification.

What is claimed is:

1. A carton formed from a single blank of foldable paper board comprising:

A pair of sidewall panels, each hingedly connected by one scored edge to a side flap panel, A pair of side flap panels having scored edges, each hingedly connected by said scored edges to a said sidewall panel and a side flap, A pair of endwall panels hingedly attached to opposite edges of one of said sidewall panels by score lines, A pair of side flaps, each side flap hingedly connected by said scored edges to a said endwall panel and a said side flap panel, A pair of endwall panel top flaps, each hingedly connected by one of said scored edges to a said endwall panel, A pair of interlocking top panels, each hingedly connected by one of said scored edges to a said sidewall panel, And a pair of glue flaps, one hingedly attached by one of said scored edges to a said sidewall panel and the other hingedly attached by one of said scored edges to a said side flap panel, Whereby one of said glue flaps overlaps the other of said endwall panels and the other of said glue flaps overlaps the other of said side flaps when in a folded and glued position.

2. The carton of claim 1, further characterized by said side flaps having angled scored edges, each extending from a point to a midpoint of an outer free edge forming three hingedly connected triangular sections, said sections including a base triangle and two opposed right triangles, with the top edge of each said base triangle being respectively hingedly connected to the bottom edge of an endwall panel, and with a side edge of each said right triangle being respectively hingedly connected to a side edge of a side flap panel, the other non-hypotenuse edge of each right triangle forming half of said side flaps outer free edge and joined to each other at said midpoint of said side flaps outer free edge.

3. The carton of claim 1, further characterized by said pair of endwall panels each possessing, along a score line, a cut-out half circle tab lock, the top of each is to be located, from the base of its respective endwall panel, at a distance slightly less than the height of a side flap, such that said tab lock allows its respective side flap to extend through to lock closed side flap panels.

4. The carton of claim 1, further characterized by said pair of endwall panel top flaps each possessing a beveled outer free edge so as not to interfere with score lines in top panels.

5. The carton of claim 1, further characterized by said pair of glue flaps having a beveled edge extending from a score line attaching each glue flap to its adjacent panel to the outer free edge of each said glue flap, said beveled edge having an angle so as not to overlap with a score line of its attached side flap.

6. The carton of claim 1, further characterized by each of said top panels and endwall panel top flaps, automatically interengaging during erection of said carton, forming a closed top in a positive manner, so that said carton does not return to a flattened position.

* * * * *